US005297329A

United States Patent [19]

Santin et al.

[11] Patent Number: 5,297,329

[45] Date of Patent: Mar. 29, 1994

[54] APPARATUS FOR CUTTING STRING TIES OF PRODUCTS CARRIED ON PALLET-LIKE SUPPORTS

[75] Inventors: Giancarlo Santin; Armando Neri, both of Bologna, Italy

[73] Assignee: G.D. S.p.A., Bologna, Italy

[21] Appl. No.: 909,496

[22] Filed: Jul. 6, 1992

[30] Foreign Application Priority Data

Jul. 11, 1991 [IT] Italy ..... B091A000246

[51] Int. Cl.[5] ..... B23P 19/00; B65B 69/00

[52] U.S. Cl. ..... 29/564.3; 83/156; 83/909; 83/923

[58] Field of Search ..... 83/175, 909, 935, 151, 83/156, 100, 923; 29/564.3, 426.4; 414/412; 241/DIG. 38, 101.2, 101.5

[56] References Cited

U.S. PATENT DOCUMENTS 4,328,609 5/1982 Born ..... 83/909 X
4,451,967 6/1984 Stobb ..... 83/909 X
4,773,148 9/1988 Ohya et al. ..... 83/909 X
4,835,836 6/1989 van Uitert ..... 29/564.3
4,976,583 12/1990 Moltrasio ..... 414/412 X
5,105,527 4/1992 Miyata ..... 29/564.3

*Primary Examiner*—Rinaldi Rada
*Attorney, Agent, or Firm*—Guido Modiano; Albert Josif; Daniel O'Byrne

[57] ABSTRACT

The apparatus for cutting the string ties of products carried on pallet-like supports has at least one cutting unit with a transverse beam arranged above a line for the conveyance of the pallet-like supports so as to be slideable in a direction which is longitudinal to the conveyance line. The unit is moved at a speed equal to the advancement speed of the pallets. Two trucks are slideably mounted on the transverse beam and support a pair of vertically slideable arms. The arms have a cutting element, for automatically locating the string tie to be cut, and an opposite element for gripping the string tie, which cooperates with the cutting element. Rollers for removing the cut string tie cooperate with the gripping element.

5 Claims, 2 Drawing Sheets

FIG.2
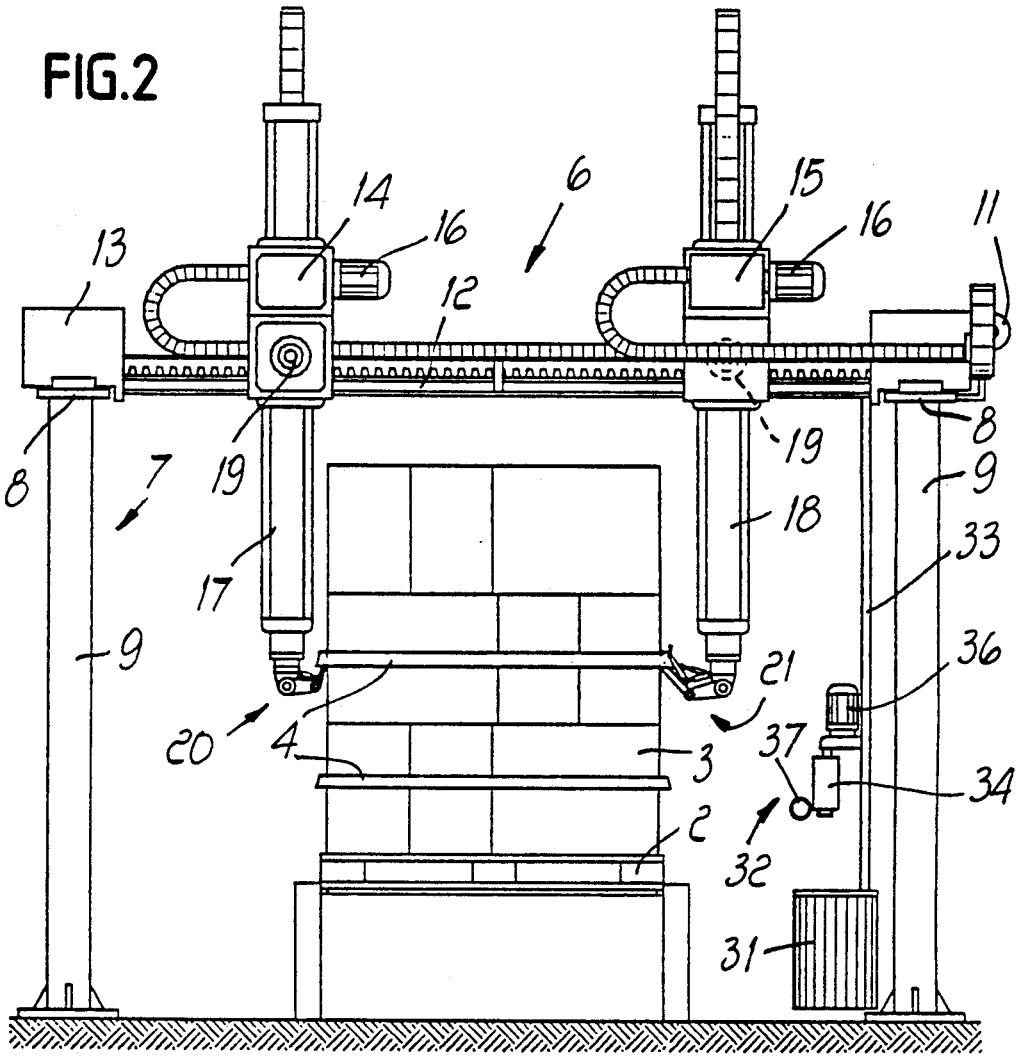
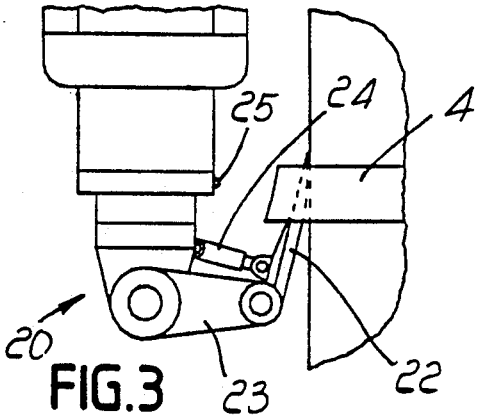
FIG.3
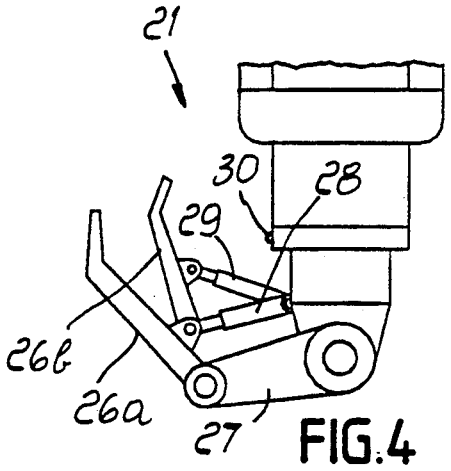
FIG.4

APPARATUS FOR CUTTING STRING TIES OF PRODUCTS CARRIED ON PALLET-LIKE SUPPORTS

BACKGROUND OF THE INVENTION

The present invention relates to an apparatus for cutting string ties of products carried on pallet-like supports.

It is known that in some production processes, the products or semiworked items to be used, packaged in packs, are conveyed to the processing stations by means of pallet-like supports on which said products are arranged stacked in layers in an orderly manner. The packs of products which form each layer are held together by a containment strap, commonly known as a "string tie", which is wrapped in a ring on a horizontal plane.

Before using the products it is necessary to remove the string ties from the products. This operation is currently performed manually by specifically assigned personnel. This generally entails the need to stop the pallet conveyance line, with an evident decrease in productivity, and also requires high labor costs.

SUMMARY OF THE INVENTION

The aim of the present invention is to solve the above problem by providing an apparatus which allows to automatically cut string ties of products carried on pallet-like supports without stopping the conveyance line which carries said pallets.

Within the scope of this aim, a further object of the present invention is to provide an apparatus for cutting string ties which is simple in concept, safe and reliable in operation and versatile in use.

According to the present invention, an apparatus for cutting string ties of products carried on pallet-like supports is provided which is characterized in that it has at least one cutting unit comprising a transverse beam arranged so as to be slideable, above a line for the conveyance of said pallet-like supports, in a direction which is longitudinal with respect to said conveyance line, and is activatable, during an active step, with a speed equal to the advancement speed of said pallets; a pair of trucks slideably mounted on said transverse beam; a pair of vertical arms vertically slideably mounted on said trucks; a cutting element carried by a first one of said arms and being actuated, during said active step, so as to automatically locate the string tie to be cut; an opposite element for gripping said string tie, supported by a second one of said arms and cooperating with said cutting element; and means for removing the cut string tie, carried by said transverse beam and cooperating with said gripping element.

BRIEF DESCRIPTION OF THE DRAWINGS

The present invention will now be described, by way of non-limitative example, with reference to the accompanying drawings, wherein:

FIG. 2 is a front view of the apparatus of FIG. 1;

FIG. 3 is a detail side view of a cutting element which is part of the apparatus of FIGS. 1 and 2;

FIG. 4 is a detail side view of a gripping element which is part of the apparatus of FIGS. 1 and 2.

DESCRIPTION OF THE PREFERRED EMBODIMENTS

Figure 1:
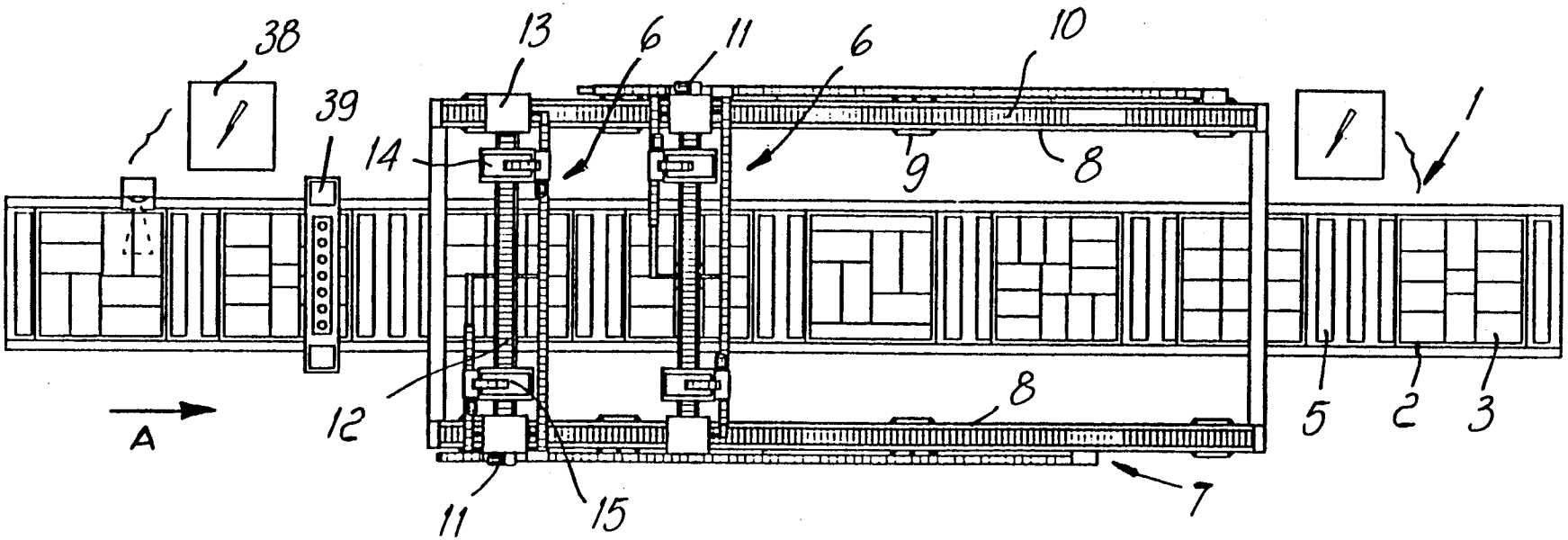
FIG. 1 is a plan view of a conveyance line for pallet-like supports equipped with an apparatus for cutting the string ties of products carried on said pallet-like supports.

With particular reference to the above figures, the reference numeral 1 generally designates a line for conveying support means, particularly the pallet-like supports 2 on which the products 3, retained by a plurality of string ties 4, are arranged; said string ties 4 are wrapped ring-like on a horizontal plane so that each one surrounds a respective layer of products. The conveyance line 1 is constituted by a conveyor with motorized rollers 5 actuated in the direction indicated by the arrow A (FIG. 1).

The apparatus for cutting the string ties 4 has a plurality of cutting units, generally designated by the reference numeral 6, arranged in series along the line 1. The number of said cutting units 6 is related to the number of pallets 2 conveyed along the line 1 per unit time, i.e. the number of cutting units is proportional, in practice, to the number of string ties 4 to be cut; in the exemplifying illustrated case, the apparatus is equipped with two cutting units 6, as shown in FIG. 1.

The cutting units 6 are supported by a frame 7 constituted by a pair of rails 8 which are arranged longitudinally with respect to the sides of the line 1 and are supported, at an appropriate height, by a series of uprights 9 arranged at equally-spaced distances along said line 1.

The rails 8 have respective racks 10 on which the cutting units 6 are supported so that they can slide under the actuation of related motor elements 11.

Each cutting unit 6 is constituted by a transverse beam 12 which is provided, at its ends, with heads 13 which are provided with the elements, (not shown in the drawings) for coupling to the racks 10. A first truck 14 and a second truck 15 are slideably mounted on the transverse beam 12 and are movable upon the actuation of a respective motor 16. The trucks 14 and 15 bear respective vertical arms 17 and 18 vertically slideable upon the actuation of related motor elements 19. The trucks 14 and 15 and the arms 17 and 18 are actuated by means of a rack system similar to the one used for the sliding of the transverse beam 12.

The first arm 17 is provided, at its lower end, with an element 20 for cutting the string tie 4, whereas the second arm 18 is provided, at its lower end, with an opposite element 21 for gripping said string tie.

The cutting element 20, illustrated in detail in FIG. 3, is constituted by a blade 22 articulated to an arm 23 which oscillates on a plane which is vertically transverse with respect to the line 1, under the actuation of an actuation element 24. The actuation of the blade 22 is controlled by a photocell sensor 25.

The gripping element 21, shown in detail in FIG. 4, is in turn constituted by a clamp formed by a pair of jaws **26*a* and 26*b* and articulated to an arm 27 which oscillates on a plane vertically transverse to the line 1, under the actuation of an actuation element 28; a further actuator 29 closes the clamp. The actuation of the clamp is controlled by a second photocell sensor 30**.

The cut string ties 4 are inserted in a discharge container 31 by appropriate removal means 32; the container 31 and the removal means 32 are supported by a rod 33 vertically coupled to the transverse beam 12 of the cutting unit.

Figure 5:
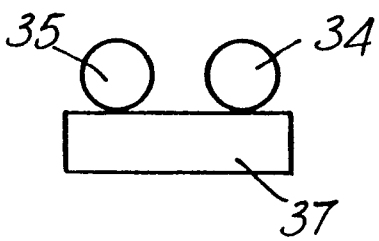
FIG. 5 is a schematic plan view of removal means which are part of the apparatus of FIGS. 1 and 2.

The removal means 32 are constituted by a pair of rollers 34 and 35 which have vertical axes; the first roller is rotated by an appropriate motor 36, whereas the other roller is idly supported so that it can be spaced with respect to the roller 35 (FIG. 5). A further roller 37 is arranged below the rollers 34 and 35 and can rotate about a horizontal axis which is longitudinal with respect to the line 1.

Upstream of the apparatus along the advancement direction of the pallets 2, there are also a reader 38 for a code (normally a bar code) with which each product 3 is provided, and a detection device 39, which provides information regarding the completeness or incompleteness of the upper layer.

The operation of the described apparatus is as follows, with reference to a single cutting unit 6. The transverse beam 12 is moved initially at the median portion of the incoming pallet 2 and is then actuated, by means of the related motor 11, at a speed which is equal to the advancement speed of said pallet, in the conveyance direction A.

During this synchronous movement of the pallet 2 and of the transverse beam 12, the cutting element 20 and the gripping element 21 are moved so that they are arranged at the string tie of the upper layer of products carried on the pallet.

The coordinates of the cutting and gripping positions to which the elements 20 and 21 move respectively, are provided by said devices 38 and 39.

Said movement consists of an approach step, during which the cutting element 20 and the grip element 21 are moved towards the pallet, by means of the sliding of the trucks 14 and 15 on the transverse beam 12, and of a location step for locating the string tie to be cut, which is performed by means of the vertical upward sliding of the arms 17 and 18 which carry said elements 20 and 21.

In this manner, the clamp of the grip element 21 is moved so that it is inserted, with the jaw 26*a*, below the string tie 4 and is simultaneously closed by means of the jaw 26*b*; simultaneously, the blade 22 of the cutting element 20 is inserted below the string tie 4, on the opposite side, is rotated counterclockwise (with respect to FIG. 3) by means of the actuator 24, so as to pull the string tie 4, and is actuated upward by means of the motor 16, so as to cut said string tie 4.

The photocell 25 of the cutting element 20 controls the correct insertion of the blade 22 below the string tie, activating the closure of the clamp 26*a*, 26*b*; in turn, the photocell 30 of the grip element 21 controls the correct closure of the clamp, activating the cutting action on the part of the blade 22.

The cut string tie, gripped by the clamp 26*a*, 26*b*, is inserted by the gripping element 21 between the rollers 34 and 35 of the removal means 32, which are in a spaced position during this step. Before the string tie 4 is released by the gripping element 21, the approach of the spaceable roller 35 is actuated and the motorized roller 34 is thus rotated, causing the movement of said roller 35. The rollers 34 and 35 thus rotate in opposite directions, so as to grip and pull the cut string tie, which falls into the underlying discharge container 31; the horizontal roller 37 cooperates in order to support the cut string tie during its removal.

Instead of being collected in the container 31, the cut string ties can be deposited on an appropriate discharge conveyor.

Meanwhile, the cutting element 20 and the gripping element 21 are moved to the string tie of the underlying layer of products, as shown in FIG. 2. The above described steps are then repeated, so as to cut and remove all of the string ties. Once the string ties have been removed, the return stroke of the cutting unit 6 to its initial working position, i.e. at the median portion of the subsequent incoming pallet, occurs. Naturally, if the apparatus has a plurality of cutting units, they can be operated in a synchronized manner on related pallets fed in series along the line 1.

The location of the string tie to be cut is performed by the cutting element 20 and by the gripping element 21 independently of each other; said location is furthermore limited automatically to an area which is defined, depending on the characteristics of the products, by means of the bar code reading method. In particular, the reader 38 identifies the coding of the incoming pallets and determines the above mentioned search area.

Said search area is further limited by the device 39 for detecting the possible incomplete filling of the pallet.

However, it is possible to provide for a different method of coding the products, for example by means of phosphorescent paints and the like.

To conclude, the described apparatus allows to automatically cut and remove the string ties of products carried on pallet-like supports. It is important to stress that the above operations are performed during the conveyance of said pallets, without stopping their advancement.

We claim:

1. Apparatus for cutting string ties of wrapped products carried on support means which are adapted for supporting at least a layer of said wrapped products, said apparatus comprising:

a conveyance line for conveying said support means at an advancement speed along a longitudinal direction;

at least one cutting unit having a transverse beam arranged above said conveyance line, said beam being slidable along said longitudinal direction at a speed equal to the advancement speed of said support means;

a pair of trucks slideably mounted on said transverse beam;

a pair of vertical arms vertically slideably mounted on said trucks;

a cutting element carried by a first one of said arms and actuatable for automatically locating the string tie to be cut;

a gripping element being supported by a second one of said arms opposite to and cooperating with said cutting element; and means for removing the cut string tie carried by said transverse beam and cooperating with said gripping element; wherein said gripping element comprises an arm articulated to said second one of said vertical arms for oscillating with respect thereto; a clamp articulated to said arm for being movable with respect thereto; and actuation elements for respectively oscillating said arm and said clamp articulated thereto with respect to said second one of said vertical arms and for actuating said clamp, the actuation of said clamp being controlled by means for detecting the presence of said string tie to be cut.

2. Apparatus according to claim 1, wherein said cutting element comprises an arm articulated to said first one of said vertical arms for oscillating with respect thereto, a blade articulated to said arm for being movable with respect thereto, an actuation element for respectively oscillating said arm and actuating said blade, and further means for detecting the presence of said string tie to be cut and for controlling the actuation of said blade.

3. Apparatus according to claim 1, further comprising a frame constituted by rails arranged longitudinally with respect to said conveyor line, a series of uprights for supporting said rails, said uprights being arranged along said conveyor line and being provided with racks on which said at least one cutting unit is slidingly supported, and coupling elements being provided at said transversal beam for engaging said racks for actuating said at least one cutting unit.

4. Apparatus according to claim 1, further comprising discharge means underlying said means for removing the cut string and being adapted for receiving said cut string ties, and motor means for actuating said means for removing the cut string, and wherein said means for removing the cut string includes a pair of rollers having vertical axes, said motor means actuating a first one of said rollers, and the second one of said rollers being idly supported and spaceable with respect to said first roller, said rollers being adapted to take said string tie from said gripping element and convey it to said underlying discharge means.

5. Apparatus for cutting string ties of wrapped products carried on support means which are adapted for supporting at least a layer of said wrapped products, said apparatus comprising:

a conveyance line for conveying said support means at an advancement speed along a longitudinal direction;

at least one cutting unit having a transverse beam arranged above said conveyance line, said beam being slidable along said longitudinally direction at a speed equal to the advancement speed of said support means;

a pair of trucks slideably mounted on said transverse beam;

a pair of vertical arms vertically slideably mounted on said trucks;

a cutting element carried by a first one of said arms and actuatable for automatically determining a location of said string tie to be cut;

a gripping element being supported by a second one of said arms opposite to and cooperating with said cutting element and being actuatable for determining a location of said string tie;

means for removing the cut string tie carried by said transverse beam and cooperating with said gripping element; means for reading bar codes of products being provided at said conveyance line; and means for detecting an incomplete filling of a said support means being provided at said conveyance line;

wherein said means for reading bar codes of products and said means for detecting incomplete filling of said support means are adapted for delimiting a search area in which said location of said string tie is locateable.

* * * * *